United States Patent [19]

Eckman

[11] 4,174,113

[45] Nov. 13, 1979

[54] BIT RETAINER FOR PNEUMATIC TOOLS

[75] Inventor: Richard E. Eckman, Houston, Tex.

[73] Assignee: Dresser Industries, Inc., Dallas, Tex.

[21] Appl. No.: 904,136

[22] Filed: May 8, 1978

[51] Int. Cl.[2] ..... B25D 17/08

[52] U.S. Cl. ..... 279/19.4; 173/132; 279/1 B; 279/75

[58] Field of Search ..... 279/1 B, 19, 19.4, 19.5, 279/19.6, 69, 70, 71, 72, 74, 75, 81, 82; 173/132

[56] References Cited

U.S. PATENT DOCUMENTS

| | | | |
|---|---|---|---|
| 1,161,907 | 11/1915 | Summers | 279/19 |
| 1,812,652 | 6/1931 | Harcourt . | |
| 1,898,726 | 2/1933 | Hess . | |
| 2,333,405 | 11/1943 | Appton . | |
| 2,453,536 | 11/1948 | Peck | 279/19 |
| 2,608,413 | 8/1952 | Peck | 279/19 |
| 2,892,556 | 5/1961 | Peck | 279/19 |
| 3,103,367 | 9/1963 | Peck . | |

OTHER PUBLICATIONS

Cleco Quick Release Chisel Retainer, Parts List No. 831847-9.

*Primary Examiner*—Z. R. Bilinsky
*Attorney, Agent, or Firm*—Roy L. Van Windle; John N. Hazelwood

[57] ABSTRACT

A bit retainer for impact type pneumatic tools arranged to be mounted on the tool and to releasably receive a bit. The retainer includes a body having a bore extending therethrough. The bore includes a nose portion of generally elliptical configuration, a center portion of circular configuration and a rear portion of generally elliptical configuration that has its major axis disposed at about 90° relative to the major axis of the front portion of the bore. Radially movable locking members are provided that operate in cooperation with a movable sleeve. The sleeve is movable between unlatched and latched positions which permit and prevent radial movement of the locking members to positively retain the bit unless the sleeve is intentionally moved to the unlatched position.

6 Claims, 7 Drawing Figures

BIT RETAINER FOR PNEUMATIC TOOLS

BACKGROUND OF THE INVENTION

This invention relates generally to an improved bit retainer for impact type pneumatic tools or the like. More specifically, this invention relates to an improved bit retainer for releasably retaining bits having an elliptical flange thereon in power tools or the like that positively prevents accidental discharge of the bit from the tool.

The bit retainer of this invention is an improvement over a latch-type quick release retainer that has been manufactured and used for a number of years. The latch-type retainer includes an oval bore for receiving the bits with oval flanges and has portions of the bore misaligned thus necessitating a quarter-turn of the bit for insertion and removal. To prevent accidental removal or discharge of the bit, a cam or latch member extends transversely of the bore between the misaligned portions. The latch member is retained by a spring which biases the latch member inwardly, blocking a portion of the bore.

The arrangement is generally effective, except that a twisting motion applied in such a way to cause relative movement between the bit and the tool, can cam the latch member out of the bore and inadvertently release the bit. It is an object of this invention to provide a bit retainer that is easily operable to insert and remove bits and, yet, one that positively prevents the inadvertent release or discharge of the bit.

SUMMARY OF THE INVENTION

This invention provides an improved bit retainer for pneumatic tools that comprises a retainer body including a nose end at the rear end arranged for connection to the pneumatic tool, the body having a bore extending axially through the ends for receiving the bit. The bore has a front portion of generally elliptical cross-section, an intermediate portion of generally circular cross-section of a diameter at least equal to the major axis of the front portion and a rear portion of generally elliptical cross-section having a major axis disposed at an angle relative to the major axis of the front portion. The body also has a pair of radially disposed ports intersecting the intermediate portion of the bore. A bit latching member is movably located in each of the ports and an annular sleeve slidingly positioned on the body. The sleeve includes an inwardly extending flange portion for engaging the latching members to limit the space therebetween to a distance approximately equal to the minor diameter of the bore in the front portion and includes an annular groove in the interior thereof for receiving the latching members to permit movement of the latching members to a position wherein the space therebetween is at least equal to the major axis of the front portion of the bore.

BRIEF DESCRIPTION OF THE DRAWING

The foregoing and additional objects and advantages of the invention will become more apparent as the following detailed description is read in conjunction with the accompanying drawings wherein like reference characters represent like parts in all views and wherein.

DETAILED DESCRIPTION OF THE PREFERRED EMBODIMENT

Figure 1:
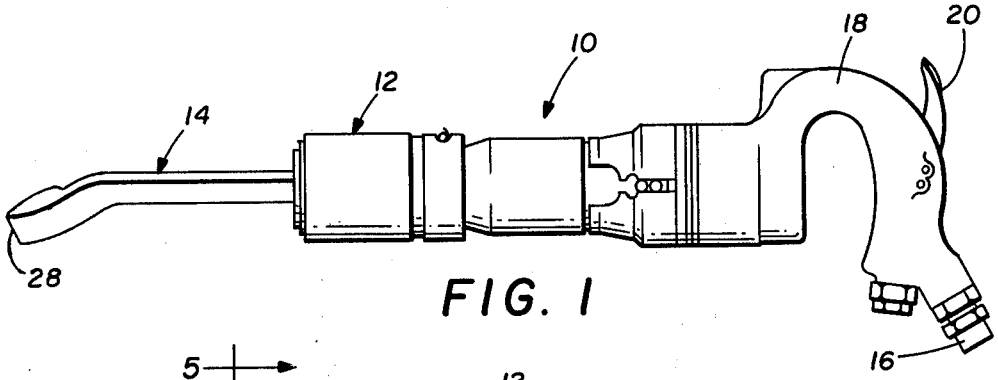
FIG. 1 is an elevation view of a pneumatic tool having a bit retainer that is constructed in accordance with the invention mounted thereon and having a bit located therein.

Referring to the drawings and to FIG. 1 in particular, shown therein and generally designated by the reference character 10, is a pneumatic impact tool having a bit retainer 12 that is constructed in accordance with the invention mounted thereon. Located in the bit retainer 12, is a chisel or chipper bit 14.

As illustrated, the tool 10 includes a fitting 16 so that the tool 10 can be connected to a source (not shown) of pressurized air. The fitting 16 is located in one end of a handle 18 which also includes a trigger 20 for actuating the tool 10.

Figure 2:
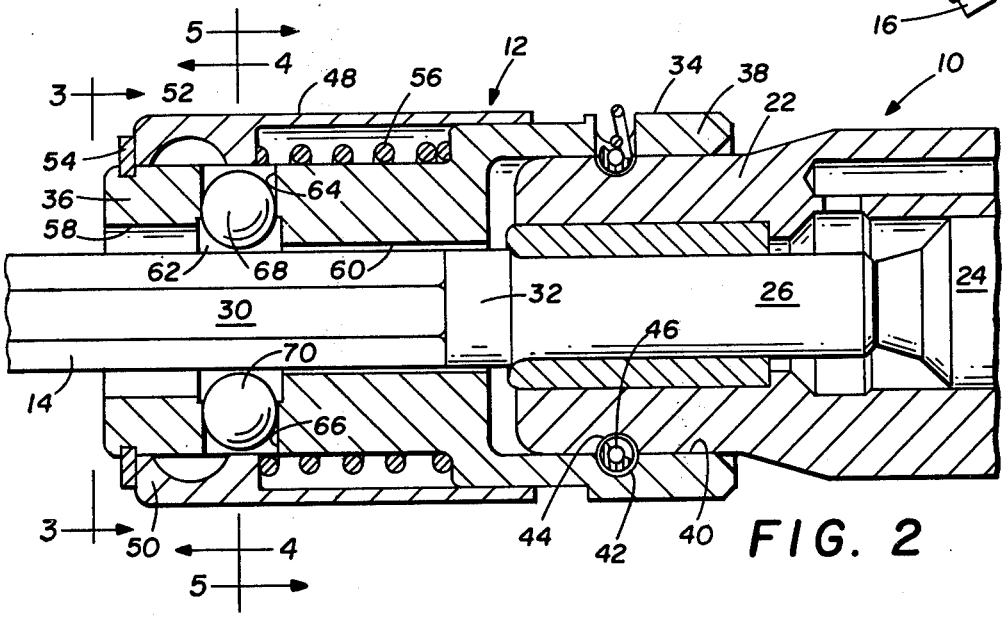
FIG. 2 is an enlarged partial cross-sectional view showing the bit retainer in the latched position.

As shown in FIG. 2, the tool 10 includes a forward portion 22 of reduced diameter that is sized and arranged to receive the bit retainer 12. The tool 10 also includes a reciprocating piston 24 that, when the tool 10 is actuated, reciprocates to impact with an impact end 26 of the bit 14.

The bit 14, in addition to the impact end 26, also includes a cutting end 28, which is illustrated as being a chipper, a hexagonal shank portion 30, and a generally elliptical flange 32 that aids in retaining the bit 14 in the tool 10 as will be explained.

The retainer 12 includes a body 34 having a nose end 36 and a rear end 38 that is provided with a countourbore 40 sized to fit over the reduced diameter portion 22 of the pneumatic tool 10. Mating annular grooves 42 and 44 are formed in the body 34 and the tool 10 for receiving a coiled spring-like retaining member 46 that serves to fasten the retainer 12 to the pneumatic tool 10.

The nose end 36 of the body 34 is reduced in diameter on its exterior to receive an annular sleeve 48. The sleeve 48 includes an inwardly extending flange 50 that has an annular groove 52 formed therein for purposes that will be explained more fully hereinafter. A lock ring 54 is located in the nose end 36 of the body 34 to limit the forward movement of the sleeve 48 retained to the body 34. A compression spring 56 is located between the sleeve 48 and the nose end 36 of the body 34 with one end in engagement with the flange 50 and the other end in engagement with body 34 so that the spring 56 biases the sleeve 48 toward the lock ring 54, that is, toward the latched position of the retainer 12 as illustrated in FIG. 2.

Figure 3:
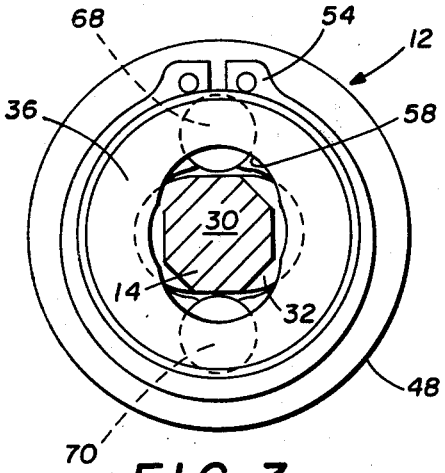
FIG. 3 is a transverse cross-sectional view taken generally along the line 3—3 of FIG. 2.
Figure 5:
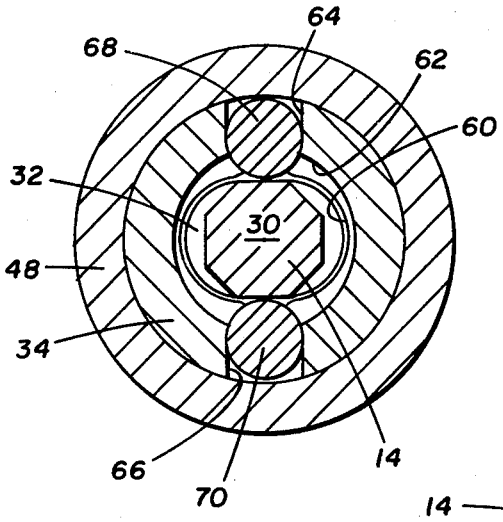
FIG. 5 is a transverse cross-sectional view taken generally along the line 5—5 of FIG. 2.

The body 34 has a bore extending therethrough, which includes a front portion 58 of generally elliptical configuration. As can be clearly seen in FIG. 3, the major axis of the front portion 58 of the bore is oriented in a vertical direction. The bore also has a rear portion 60 of generally elliptical configuration that has its major axis oriented in the horizontal direction as can be seen clearly in FIG. 5. The portions 58 and 60 of the bore are generally of the same configuration as the elliptical flange 32 on the bit 14 and of slightly larger size so that the bit 14 can be passed therethrough.

Figure 4:
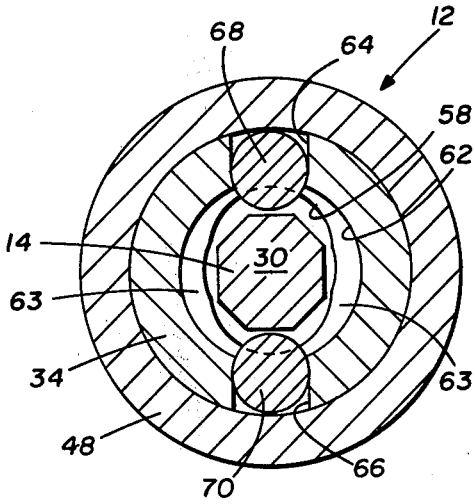
FIG. 4 is a transverse cross-sectional view taken generally along the line 4—4 of FIG. 2.

Located between the front portion 58 and the rear portion 60 of the bore is an intermediate portion 62 of circular cross-section as can be seen clearly on FIG. 4. The diameter of the circular cross-section 62 is at least equal to the major axis of the portions 58 and 60 of the bore. The relative enlargement of the portion 62, relative to the size of the minor axis of the front portion 58, provides a pair of rearwardly facing, radially disposed surfaces 63.

Figure 6:
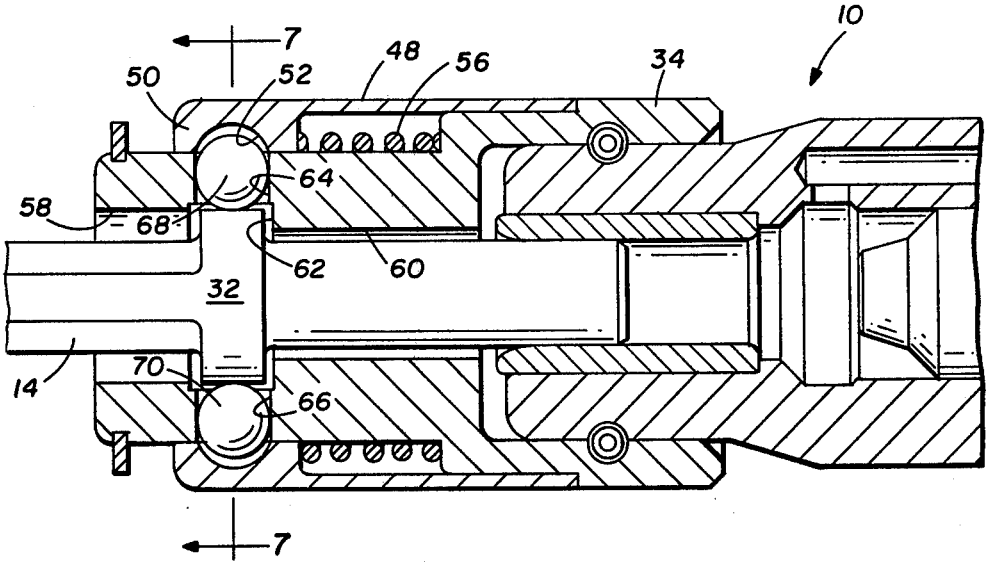
FIG. 6 is a cross-sectional view similar to FIG. 2, but illustrating the bit retainer in an unlatched position.

A pair of radially oriented ports 64 and 66 extend through the body 34 intersecting the intermediate portion 62 of the bore. The ports 64 and 66 are sized to receive latch members 68 and 70. As illustrated, the latch members 68 and 70 are spherical. The latch members 68 and 70 have been sized so that when in engagement with the flange 50 on the sleeve 48, the distance therebetween will be approximately the same as the minor axis of the elliptical flange 32 on the bit 14 and less than the major axis thereof. It should also be pointed out that the annular groove 52 formed in the sleeve 48 is sized to permit the latching members 68 and 70 to move radially outwardly when the annular groove 52 is aligned with the ports 64 and 66 as illustrated in FIG. 6. When moved outwardly, the distance between the members 68 and 70 will be equal to or slightly larger than the major axis of the elliptical flange 32 on the bit 14 to permit the bit 14 to pass therebetween.

OPERATION OF THE PREFERRED EMBODIMENT

Without a bit 14 in the retainer 12, the various components of the sleeve 12 will be in a position illustrated in FIG. 2, except that the bit 14 will not be located therein. Stated in another way, the sleeve 48 will be in the forward or latched position, that is, with the flange 50 of the sleeve 48 in engagement with the lock ring 54. In this position, the latching members 68 and 70 cannot be moved radially outwardly in the ports 64 and 66.

Figure 7:
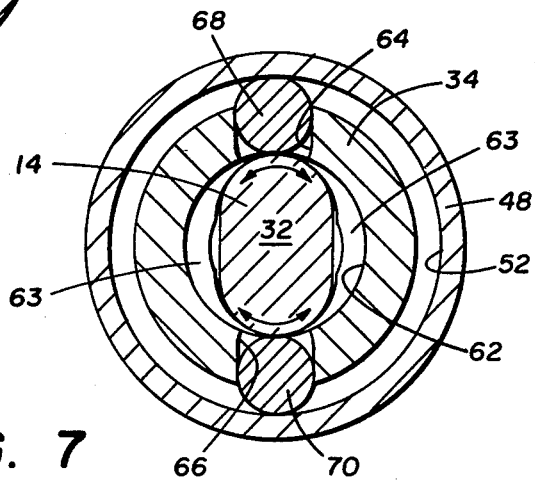
FIG. 7 is a transverse cross-sectional view taken generally along the line 7—7 of FIG. 6.

When it is desired to insert the bit 14 into the retainer 12, the tool operator pulls the sleeve 48 toward the tool 10 compressing the spring 56 and moving the annular groove 52 of the sleeve 48 into alignment with the radial ports 64 and 66. The bit 14 is inserted with the elliptical flange 32 aligned with the front portion 58 of the bore until the flange 32 engages the latching members 68 and 70. Further inward movement of the bit 14 forces the latching members 68 and 70 outwardly in the ports 64 and 66 into the recess 52 in the sleeve 48 as illustrated in FIG. 6. It will be appreciated that the elliptical flange 32 is now within the intermediate or circular portion 62 of the bore and the bit 14 can be rotated to the left or to the right as illustrated by the arrows in FIG. 7 until the major axis of the elliptical flange 32 aligns with the major axis of the rear portion 60 of the bore. When the elliptical flange 32 is so aligned, the bit 14 can be shoved farther into the retainer 12 and the tool 10 to the position illustrated in FIG. 2.

After the elliptical flange 32 enters the rear portion 60 of the bore, the sleeve 48 can be released by the operator and, under the influence of the spring 56, the sleeve 48 is returned into engagement with the lock ring 54. The forward movement of the sleeve 48 forces the locking members 68 and 70 radially inwardly toward the bit 14 and into the position illustrated in FIG. 2.

The bit retainer 12 is now in the latched position, that is, it is in a position wherein the flange 50 on the sleeve 48 prevents outward movement of the locking members 68 and 70 and thereby, prevents rotation of the bit 14. Accordingly, the major axis of the elliptical flange 32 is disposed generally perpendicularly with respect to the major axis of the front portion 58 of the bore and, since the bit 14 cannot be rotated, the elliptical flange 32 will engage the surfaces 63 and cannot enter the front portion 50 of the bore. Thus, the bit 14 cannot be discharged from the tool 10.

To remove the bit 14 from the tool 10, the operator grasps the sleeve 48 and pulls it toward the tool 10 realigning the annular groove 52 in the sleeve 48 with the locking members 68 and 70 whereupon the bit 10 can be rotated to realign the major axis of the elliptical flange 32 with the major axis of the front portion 58 of the bore. When in this position (illustrated in FIG. 6), the bit 14 can be pulled out of the tool 10.

From the foregoing, it will be appreciated that the bit retainer 12 described in detail hereinbefore, is of relatively simple construction and, yet, is very effective in preventing the inadvertent discharge of the bit 14 from the tool 10. It is impossible without a mechanical failure of the sleeve 48 or the shearing of the flange 32 from the bit 14 for the bit 14 to be discharged or removed therefrom.

Having described but a single embodiment of the invention, it will be appreciated that it is presented by way of example only, and that many changes and modifications can be made thereto without departing from the spirit of the invention.

The embodiments of the invention in which an exclusive property or privilege is claimed are defined as follows:

1. An improved retainer for releasably securing bits, such as chisels, chippers, or the like, having a generally elliptical flange on the shanks thereof in pneumatic tools comprising:

a retainer body including a nose end and a rear end arranged for connection to the pneumatic tool, said body having a bore extending axially through said ends for receiving the bit, said bore having a front portion of generally elliptical cross-section to receive the elliptical flanges, an intermediate portion of generally circular cross-section of a diameter at least equal to the major axis of said front portion, and a rear portion of approximately the same cross-section as said front portion, said rear portion having a major axis disposed at an angle relative to the major axis of said front portion and said body also having a pair of radially disposed ports intersecting the intermediate portion of said bore;

a bit latching member movably located in each of said ports; and, an annular sleeve slidingly positioned on said body for movement between latched and unlatched positions, said sleeve including an inwardly extending flange portion for engaging said latching members when said sleeve is in a latched position to limit the space between said members to a distance approximately equal to the minor diameter of the bore in said front portion, said sleeve having a groove in the interior thereof for receiving said latching members when said sleeve is in an unlatched position to permit radial movement of said latching members to a position wherein the space therebetween is at least equal to the major axis of the front portion of said bore.

2. The bit retainer of claim 1 and also including resilient means having first and second ends and being located between said sleeve and body, said first end engaging the inwardly extending flange portion of said sleeve and said second end engaging said body for biasing said sleeve toward the latched position wherein said flange engages said latch members to limit the space therebetween to a distance approximately equal to the minor diameter of the bore in said front portion.

3. The bit retainer of claim 2 wherein said latching members are spherical in configuration.

4. The bit retainer of claim 3 and also including:

a lock ring mounted on said nose end for engaging said inwardly extending flange portion to limit the extent of movement of said sleeve; and means carried by said rear end for releasably attaching said retainer to the pneumatic tool.

5. The bit retainer of claims 1 or 2 wherein the angle between said major axes is approximately 90°.

6. The bit retainer of claim 5 wherein said radially disposed parts are located approximately 180° apart and each is located at an angle of approximately 90° relative to the major axis of the rear portion of said bore.

* * * * *